US009400102B2

(12) United States Patent
Kagawa et al.

(10) Patent No.: US 9,400,102 B2
(45) Date of Patent: Jul. 26, 2016

(54) HEAT EXCHANGER INCLUDING FLOW REGULATING PLATES

(75) Inventors: Seiji Kagawa, Hiroshima-ken (JP); Moritoshi Murakami, Hiroshima-ken (JP); Yuichiro Sato, Hiroshima-ken (JP); Naoyuki Kamiyama, Hiroshima-ken (JP); Tsuyoshi Miyaji, Hiroshima-ken (JP)

(73) Assignee: MITSUBISHI HITACHI POWER SYSTEMS, LTD., Yokohama (JP)

( * ) Notice: Subject to any disclaimer, the term of this patent is extended or adjusted under 35 U.S.C. 154(b) by 1022 days.

(21) Appl. No.: 13/059,884

(22) PCT Filed: Aug. 6, 2009

(86) PCT No.: PCT/JP2009/063965

§ 371 (c)(1),
(2), (4) Date: Feb. 18, 2011

(87) PCT Pub. No.: WO2010/106699

PCT Pub. Date: Sep. 23, 2010

(65) Prior Publication Data

US 2011/0139426 A1 Jun. 16, 2011

(30) Foreign Application Priority Data

Mar. 18, 2009 (JP) ..... 2009-065610

(51) Int. Cl.
*F28F 9/02* (2006.01)
*F28F 9/22* (2006.01)
(Continued)

(52) U.S. Cl.
CPC . *F22B 37/40* (2013.01); *F22B 1/18* (2013.01); *F23M 9/003* (2013.01)

(58) Field of Classification Search
CPC ..... F22B 1/18; F22B 37/40; F23J 13/00
USPC ..... 165/159, 161, 174, 134.1; 138/39; 122/7 R, 31.1
See application file for complete search history.

(56) References Cited

U.S. PATENT DOCUMENTS 3,191,630 A * 6/1965 Demyan ..... 138/42
3,996,025 A * 12/1976 Gulden ..... 48/107
(Continued)

FOREIGN PATENT DOCUMENTS

JP 60-076708 U 5/1985
JP 60-128107 U 8/1985
(Continued)

OTHER PUBLICATIONS

Translation of Japanese document JP 08110007 A named JP-H8110007_TRANSLATION.*
(Continued)

*Primary Examiner* — M. Alexandra Elve
*Assistant Examiner* — Paul Alvare
(74) *Attorney, Agent, or Firm* — Westerman, Hattori, Daniels & Adrian, LLP

(57) ABSTRACT

In a heat exchanger that includes an expanded part of a duct, a heat-transfer tube bundle accommodating duct, and a plurality of heat-transfer tube bundles provided in the heat-transfer tube bundle accommodating duct in a flow direction of flue gas with a distance therebetween, a bare-tube-part upstream-side regulating plate and a bare-tube-part downstream-side regulating plate at an upstream side and a downstream side of a bare tube part of each of the heat-transfer tube bundles and a plurality of regulating plates in an introducing unit arranged either in the expanded part of a duct or in the heat-transfer tube bundle accommodating duct on an upstream side to the heat-transfer tube bundle are provided. A drift at the bare tube part of the heat-transfer tube bundles can be significantly reduced.

7 Claims, 4 Drawing Sheets

(51) Int. Cl.

| | |
|---|---|
| ***F28F 19/00*** | (2006.01) |
| ***F15D 1/04*** | (2006.01) |
| ***F22B 1/18*** | (2006.01) |
| ***F22B 1/02*** | (2006.01) |
| ***F22B 37/40*** | (2006.01) |
| ***F23M 9/00*** | (2006.01) |

(56) References Cited

U.S. PATENT DOCUMENTS

| | | | | | |
|---|---|---|---|---|---|
| 4,280,360 | A | * | 7/1981 | Kobayashi et al. | 73/198 |
| 4,455,281 | A | * | 6/1984 | Ishida et al. | 422/171 |
| 4,685,426 | A | * | 8/1987 | Kidaloski et al. | 122/214 |
| 5,131,459 | A | * | 7/1992 | Thompson et al. | 165/67 |
| 5,680,884 | A | * | 10/1997 | Nishijima et al. | 138/39 |
| 6,340,002 | B1 | * | 1/2002 | Liebig | 122/7 R |

FOREIGN PATENT DOCUMENTS

| | | | | |
|---|---|---|---|---|
| JP | 6-006901 | U | | 1/1994 |
| JP | H066901 | U | * | 1/1994 |
| JP | 08028808 | A | * | 2/1996 |
| JP | 8-110007 | A | | 4/1996 |
| JP | 08110007 | A | * | 4/1996 |
| JP | 8-145301 | A | | 6/1996 |
| JP | 08159402 | A | * | 6/1996 |
| JP | 09-137906 | A | | 5/1997 |
| JP | 11-072202 | A | | 3/1999 |
| JP | 11-118101 | A | | 4/1999 |
| JP | 3546132 | B2 | | 7/2004 |
| JP | 3572139 | B2 | | 9/2004 |
| JP | 2006-214625 | A | | 8/2006 |
| JP | 2007-298244 | A | | 11/2007 |
| JP | 2008-032367 | A | | 2/2008 |

OTHER PUBLICATIONS

Translation of Japanese document JPH066901 U named JP-H66901_TRANSLATION.*

Translation of Japanese document JP 08028808 A named JP-H8028808_TRANSLATION.*

Translation of Japanese document JP 08159402 A named JP-H8159402_TRANSLATION.*

Japanese Patent Document No. JP 08028808 A.*

Japanese Patent Document No. JP 08159402 A.*

Japanese Patent Document No. JPH066901 U.*

Japanese Patent Document No. JP 08110007 A.*

Japanese Office Action dated Sep. 20, 2011, issued in corresponding Japanese Patent Application No. 2009-065610.

International Search Report of PCT/JP2009/063965, mailing date Nov. 2, 2009.

Written Opinion of the International Searching Authority , issued in corresponding International Application No. PCT/JP2009/063965.

Notice of Allowance dated Jul. 24, 2012, issued in the Taiwanese Patent Application No. 098133291, with English translation (5 pages).

Korean Notice of Allowance mailed Apr. 3, 2013, issued in corresponding Korean Patent Application No. 10-2011-7003860; w/partial English translation (3 pages).

* cited by examiner

HEAT EXCHANGER INCLUDING FLOW REGULATING PLATES

FIELD

The present invention relates to a heat exchanger that makes a gas flow in a heat exchanger, such as a heat recovery device, uniform.

BACKGROUND

There has been conventionally disclosed a device such that in a heat transfer tube arranged in a zigzag pattern by a bent part formed in a path of flue gas, because wear of a bent part near a furnace wall where a drift occurs is large, a baffle plate is placed on the furnace wall between adjacent bent parts, so that a drift is prevented (for example, see Patent Literature 1).

Further, a device for preventing wear of a looped tube in a rear heat transfer unit of a coal combustion boiler has been disclosed, where the rear heat transfer unit is connected via a sub-sidewall to a rear side of a furnace, and a reheater and a superheater that are constituted by a plurality of looped tubes are placed in the rear heat transfer unit, an erosion baffle that has a predetermined width in a substantially horizontal direction to extend toward a flow path is mounted on a heat transfer tube wall that constitutes the rear heat transfer unit above bent ends of looped tubes of the reheater and the superheater, and holes for passing coal ash are formed on the entire surface of the erosion baffle (for example, see Patent Literature 2).

Further, there has been disclosed a device in which a drift preventing plate is provided at a position on a sidewall of a boiler above heat exchanger tubes (for example, see Patent Literature 3).

Further, there has been disclosed a horizontal-type heat exchanger for a coal combustion boiler. In this heat exchanger, to prevent wear and damage of a heat transfer tube due to coal ash, a horizontal element is constituted by bare tubes for the second tier from the top and spiral fin tubes for the third and subsequent tiers, and a drift preventing plate is provided because a large amount of gas flows into a space between an end of the horizontal element and a sidewall tube and then tubes near the space are damaged (for example, see Patent Literature 4).

Further, there has been disclosed an exhaust-heat recovery unit that recovers heat from flue gas in a gas turbine. The exhaust-heat recovery unit includes a duct for which four surfaces are respectively constituted by front, rear, and side duct casings and in which flue gas passes, and a finned heat transfer tube group constituted by a plurality of finned heat transfer tubes that are provided in the duct so as to be perpendicular to a flow direction of the flue gas and whose axis longitudinal direction is in parallel with the side duct casing. In this exhaust-heat recovery unit, baffles that are fixed to inner surfaces of the side duct casings on an upstream side and a downstream side of flue gas in the finned heat transfer tube group so as to cover ends of the finned heat transfer tube group along the tube axis longitudinal direction are provided (for example, see Patent Literature 5).

As described above, various types of regulating plates (a baffle plate, an erosion baffle, a drift preventing plate, and a baffle) have been conventionally proposed to make a gas flow in a heat exchanger (a heat transfer tube, a repeater, a heater, a heat exchanger tube a heat transfer tube, or an exhaust-heat recovery unit) uniform.

However, according to the devices described in Patent Literatures 1 to 5, regulating plates are provided only near a heat exchanger and thus sufficient regulation (reduction in drift) cannot be achieved.

Citation List

Patent Literatures

Patent Literature 1: Japanese Utility Model Laid-open Publication No. S60-128107 (Japanese Utility Model Application No. S59-12671)

Patent Literature 2: Japanese Patent Application Laid-open No. H08-110007

Patent Literature 3: Japanese Patent Application Laid-open No. H11-72202

Patent Literature 4: Japanese Patent Application Laid-open No. H11-118101

Patent Literature 5: Japanese Patent Application Laid-open No. H9-137906

SUMMARY

Technical Problem

The present invention has been achieved to solve the above problems, and an object of the present invention is to provide a heat exchanger that can reduce a drift significantly.

Solution to Problem

The present invention employs the following means in order to solve the above problems.

According to an aspect of the present invention, a heat exchanger including an expanded part of a duct, a heat-transfer tube bundle accommodating duct, and a plurality of heat-transfer tube bundles provided in the heat-transfer tube bundle accommodating duct in a flow direction of flue gas with a distance therebetween, includes: a bare-tube-part upstream-side regulating plate and a bare-tube-part downstream-side regulating plate respectively arranged on an upstream side and a downstream side of a bare tube part of each of the heat-transfer tube bundles; and a plurality of regulating plates in an introducing unit arranged either in the expanded part of a duct or in the heat-transfer tube bundle accommodating duct on an upstream side to the heat-transfer tube bundles.

Advantageously, in the heat exchanger, the bare-tube-part upstream-side regulating plate or the bare-tube-part downstream-side regulating plate is a flat plate.

Advantageously, in the heat exchanger, the bare-tube-part upstream-side regulating plate has a plurality of holes.

Advantageously, in the heat exchanger, an aperture ratio of the plurality of holes of the bare-tube-part upstream-side regulating plate is 20 to 50%.

Advantageously, in the heat exchanger, a length between the bare-tube-part upstream-side regulating plate and a heating medium tube on an uppermost stream side of each of the heat-transfer tube bundles is ten or more times of a diameter D of the holes.

Advantageously, in the heat exchanger, a plurality of openings are formed on each of the regulating plates in an introducing unit such that a pressure loss coefficient is set to be within 1 to 3.

Advantageously, in the heat exchanger, the regulating plates in an introducing unit are formed by arranging band-shaped flat plates in parallel crosses.

Advantageously, in the heat exchanger, a plurality of openings on each of the regulating plates in an introducing unit on a downstream side are formed such that a total area thereof is equal to or larger than a total area of a plurality of openings formed on the regulating plate in an introducing unit on an upstream side.

Advantageous Effects of Invention

The inventions according to the appended claims use the means described above. Flue gas that flows into a heat exchanger is regulated by a plurality of regulating plates in an introducing unit provided either in the expanded part of a duct or in the heat-transfer tube bundle accommodating duct on an upstream side to the heat-transfer tube bundles, and the regulated flue gas flows into each of the heat-transfer tube bundles. Accordingly, a drift can be suppressed significantly by the bare-tube-part upstream-side regulating plate and the bare-tube-part downstream-side regulating plate respectively arranged on the upstream side and the downstream side of the bare tube part of each of the heat-transfer tube bundles.

BRIEF DESCRIPTION OF DRAWINGS

FIG. 3 are configuration diagrams of a regulating plate in an introducing unit shown in FIG. 2, where

DESCRIPTION OF EMBODIMENTS

<Outline Of Thermal Power Plant>

An overall configuration of a thermal power plant that utilizes a heat exchanger according to an embodiment of the present invention is explained with reference to FIG. 1.

Coal and petroleum are used as the fuel for a boiler 1, and air pollutants such as nitrogen oxides (NOX), sulfur oxides (SOX), and dust are contained in flue gas from the boiler 1.

Figure 1:
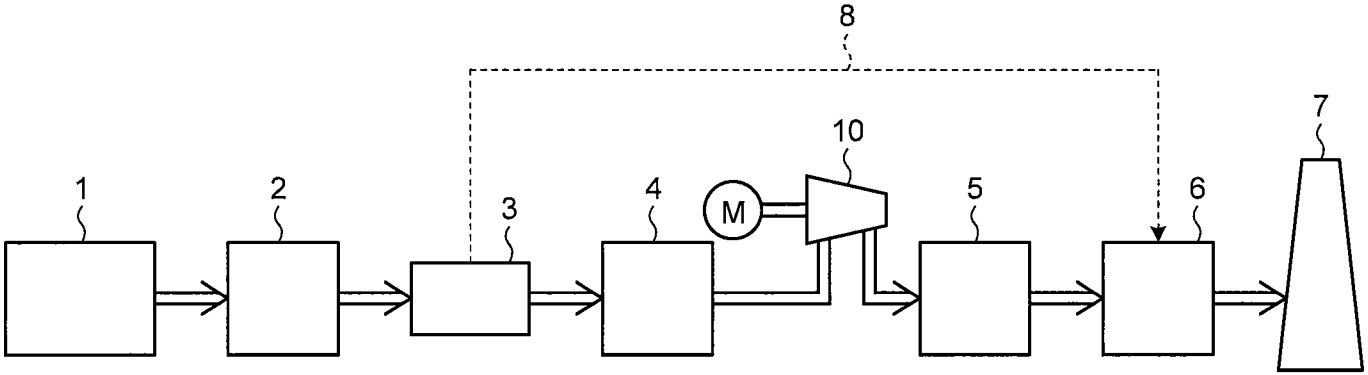
FIG. 1 is an overall configuration diagram of a thermal power plant that utilizes a heat exchanger according to an embodiment of the present invention.

As shown in FIG. 1, the flue gas discharged from the boiler 1 is introduced into a denitrification system 2 having a catalyst filled therein.

In the denitrification system 2, NOX in the flue gas is reduced to water and nitrogen by ammonium (NH3) charged as a reducing agent so as to become harmless.

High temperature flue gas discharged from the denitrification system 2 passes through an air heater (A/H), and the temperature of the flue gas is generally 120 to 150° C.

This high temperature flue gas is introduced into a heat recovery unit 3 serving as a heat exchanger, and heat exchange is performed with a heating medium (such as water), so that it is thermally recovered.

The temperature of the flue gas discharged from the heat recovery unit 3 is 80 to 110° C.

The heating medium heated by the heat recovery unit 3 is sent through a heating-medium circulating pipe 8 to a repeater 6 to be described later.

A soot blower 9 is provided at a side of the heat recovery unit 3.

Low temperature flue gas discharged from the heat recovery unit 3 is mixed and introduced into an electronic precipitator 4, so that dust is removed from the low temperature flue gas.

Flue gas from which dust is removed is pressurized by an air blower (an ID fan) 10 that is driven by a motor.

There are cases that the air blower 10 is not provided.

The flue gas is then introduced into a desulfurization system 5.

In the desulfurization system 5, SOX in the flue gas is absorbed and removed by limestone and gypsum is produced as a by-product.

At this time, the temperature of the flue gas discharged from the desulfurization system 5 is generally reduced to 45 to 55° C.

When this flue gas is discharged into air as it is, there are problems such that it is hardly diffused because of its low temperature and can become white smoke.

Therefore, the flue gas is introduced into the reheater 6. In the reheater 6, the flue gas is heated to a predetermined temperature or higher by a heating medium sent from the heat recovery unit 3 through the heating-medium circulating pipe 8 and the resultant gas is discharged from a stack 7.

While an example of the boiler 1 is shown in FIG. 1, various types of flue gas generators such as an internal combustion engine, a gas turbine, and an incinerator can be also used.

Furthermore, a thermal power generation plant and a refuse incineration plant can be used as the thermal power plant.

<Configuration Of Heat Exchanger>

Details of the heat recovery unit 3 serving as a heat exchanger are explained next with reference to FIG. 2.

Figure 2:
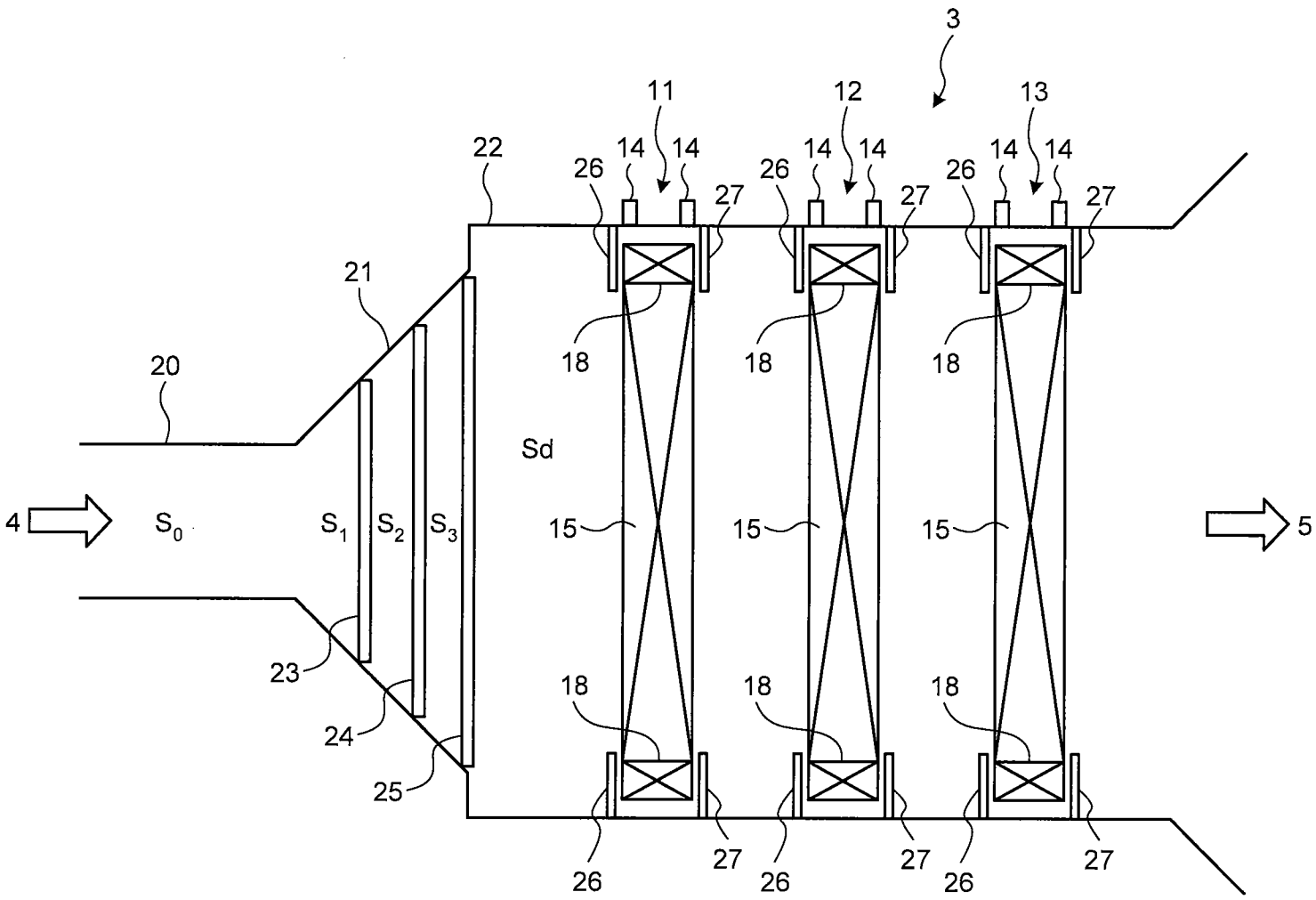
FIG. 2 is an enlarged plan view of the heat exchanger shown in FIG. 1.

In addition to the heat recovery unit 3 shown in FIG. 2, examples of the heat exchanger include a heat transfer tube, a repeater, a superheater, a heat exchanger tube, and a heat transfer tube.

As shown in FIG. 2, the duct-shaped heat recovery unit 3 with a rectangular cross-section is connected to a flue gas duct 20 on a downstream side of the denitrification system 2.

Flue gas discharged from the denitrification system 2 shown in FIG. 1 is introduced into the heat recovery unit 3.

The heat recovery unit 3 is constituted by an expanded part 21 of a duct connected to a downstream side of the flue gas duct 20 and a heat-transfer tube bundle accommodating duct 22 connected to a downstream side of the expanded part 21 of a duct.

A plurality of regulating plates 23 to 27 are mounted either in the expanded part 21 of a duct or the heat-transfer tube bundle accommodating duct 22 as explained below.

<Regulating Plates in Duct>

As shown in FIG. 2, three regulating plates (perforated plates) 23, 24, and 25 in an introducing unit are mounted on the expanded part 21 of a duct.

One or all of the three regulating plates (perforated plates) 23, 24, and 25 in an introducing unit can be mounted on the heat-transfer tube bundle accommodating duct 22 (on an upstream side to a fin tube part 15).

Figure 3A:
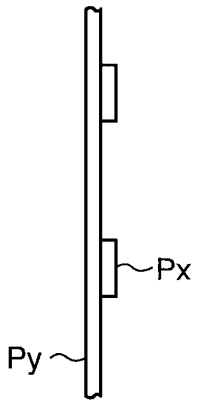
FIG. 3A is a side view and FIG. 3B is a front view.
Figure 3B:
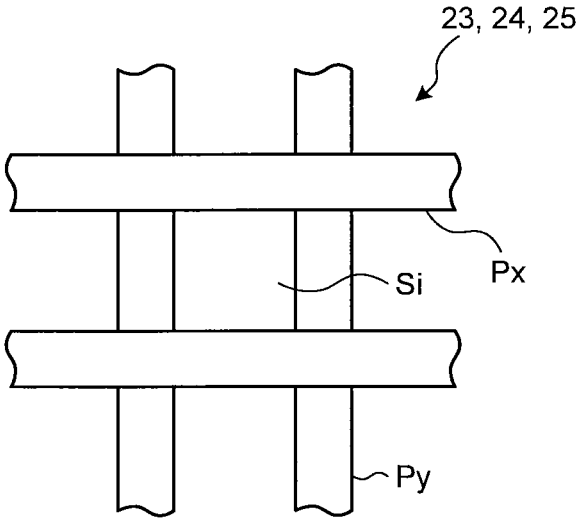

As shown in a side view of FIG. 3A and a front view of FIG. 3B, each of the regulating plates 23, 24, and 25 in an introducing unit is formed by arranging a plurality of band-shaped horizontal flat plates Px and a plurality of band-shaped vertical flat plates Py in parallel crosses.

In this case, openings of each of the regulating plates 23, 24, and 25 in an introducing unit are determined such that a total pressure loss coefficient of the three plates (or when only two of the three regulating plates 23, 24, and 15 are provided) is set to be within 1 to 3, preferably 2.

As a cross-sectional area of the flue gas duct 20 is denoted by So, a total cross-sectional area of a large number of (a plurality of) openings of the first regulating plate 23 in an introducing unit is denoted by S1, a total cross-sectional area of a large number of (a plurality of) openings of the second regulating plate 24 in an introducing unit is denoted by S2, a total cross-sectional area of a large number of (a plurality of) openings of the third regulating plate 25 in an introducing unit is denoted by S3, and a cross-sectional area of the heat-transfer tube bundle accommodating duct 22 is denoted by Sd, a large number of (a plurality of) openings are formed on the respective regulating plates 23, 24, and 25 in an introducing unit so that S1<S2<S3<Sd is satisfied.

At least, the total cross-sectional area S3 of the openings of the third (the down-most stream side) regulating plate 25 in an introducing unit is larger than the cross-sectional area So of the flue gas duct 20.

As described above, the regulating plates 23, 24, and 25 in an introducing unit are constituted so that the total cross-sectional area of a large number of (a plurality of) openings becomes gradually larger toward a downstream. Accordingly, ash erosion near an entrance of a heat recovery unit 3*a* or 3*b* can be prevented.

For example, the regulating plates are constituted so that the following condition is satisfied; that is, the cross-sectional area So<the total cross-sectional area S1<the total cross-sectional area S2<the total cross-sectional area S3<the cross-sectional area Sd, the total cross-sectional area S1<the cross-sectional area So<the total cross-sectional area S2<the total cross-sectional area S3<the cross-sectional area Sd, or the total cross-sectional area S1<the total cross-sectional area S2<the cross-sectional area So<the total cross-sectional area S3<the cross-sectional area Sd.

In this case, according to the plate formed by arranging flat plates in parallel crosses as shown in FIG. 3, the number of the horizontal flat plates Px is equal to the number of the vertical flat plates Py and a distance between arranged horizontal flat plates Px or arranged vertical flat plates Py is equal or larger toward the regulating plates 23, 24, and 25 in an introducing unit on the downstream side. The total cross-sectional areas S1, S2, and S3 of a large number of (a plurality of) openings can thus be larger toward the downstream.

Alternatively, the number of the horizontal flat plates Px and the vertical flat plates Py can be increased toward the regulating plates 23, 24, and 25 in an introducing unit on the downstream side while the size of a large number of (a plurality of) openings is unchanged.

Two or four or more (a plurality of) regulating plates in an introducing unit can be provided.

The shape of each of the regulating plates 23, 24, and 25 in an introducing unit is not limited to that shown in FIG. 3, and a large number of circular openings can be formed on a flat plate.

The regulating plate 25 in an introducing unit on the down-most stream side can be mounted on the heat-transfer tube bundle accommodating duct 22.

The regulating plates 23, 24 and 25 in an introducing unit are constituted such that positions of the openings of the first regulating plate 23 in an introducing unit in vertical and horizontal directions do not coincide with those of the second regulating plate 24 in an introducing unit in the vertical and horizontal directions, or the positions of the openings of the second regulating plate 24 in an introducing unit in the vertical and horizontal directions do not coincide with those of the third regulating plate 25 in an introducing unit in the vertical and horizontal directions. With this configuration, the flow of the flue gas can be made more uniform.

According to the configuration shown in FIG. 3, for example, the position of a portion on the downstream side where the horizontal flat plate Px crosses the vertical flat plate Py in the vertical and horizontal directions is at the position of an opening Si on an upstream side in the vertical and horizontal directions.

<Regulating Plate In Heat-Transfer Tube Bundle Accommodating Duct>

As shown in FIG. 2, three (a plurality of) heat-transfer tube bundles, that is, a high-temperature heat-transfer tube bundle 11, a medium-temperature heat-transfer tube bundle 12, and a low-temperature heat-transfer tube bundle 13 are mounted on the heat-transfer tube bundle accommodating duct 22 of the heat recovery unit 3 in a flow direction of flue gas with a distance therebetween.

Each of the heat-transfer tube bundles 11 to 13 is constituted by the fin tube part (heat transfer unit) 15 of a plurality of columns and a large number of tiers and a bare tube part (U-shaped tube part) 18 that connects ends of adjacent ones of the fin tube parts (heat transfer units) 15.

An upstream end and a downstream end of each of the heat-transfer tube bundles 11 to 13 are respectively connected to headers 14 mounted on a wall surface of the heat recovery unit 3.

The heating-medium circulating pipe 8 shown in FIG. 1 is connected to each of the headers 14.

Furthermore, a bare-tube-part upstream-side regulating plate 26 and a bare-tube-part downstream-side regulating plate 27 are respectively mounted on an upstream side and a downstream side of the bare tube part 18 at ends of each of the fin tube parts 15 so as to cover the bare tube part 18.

Figure 4:
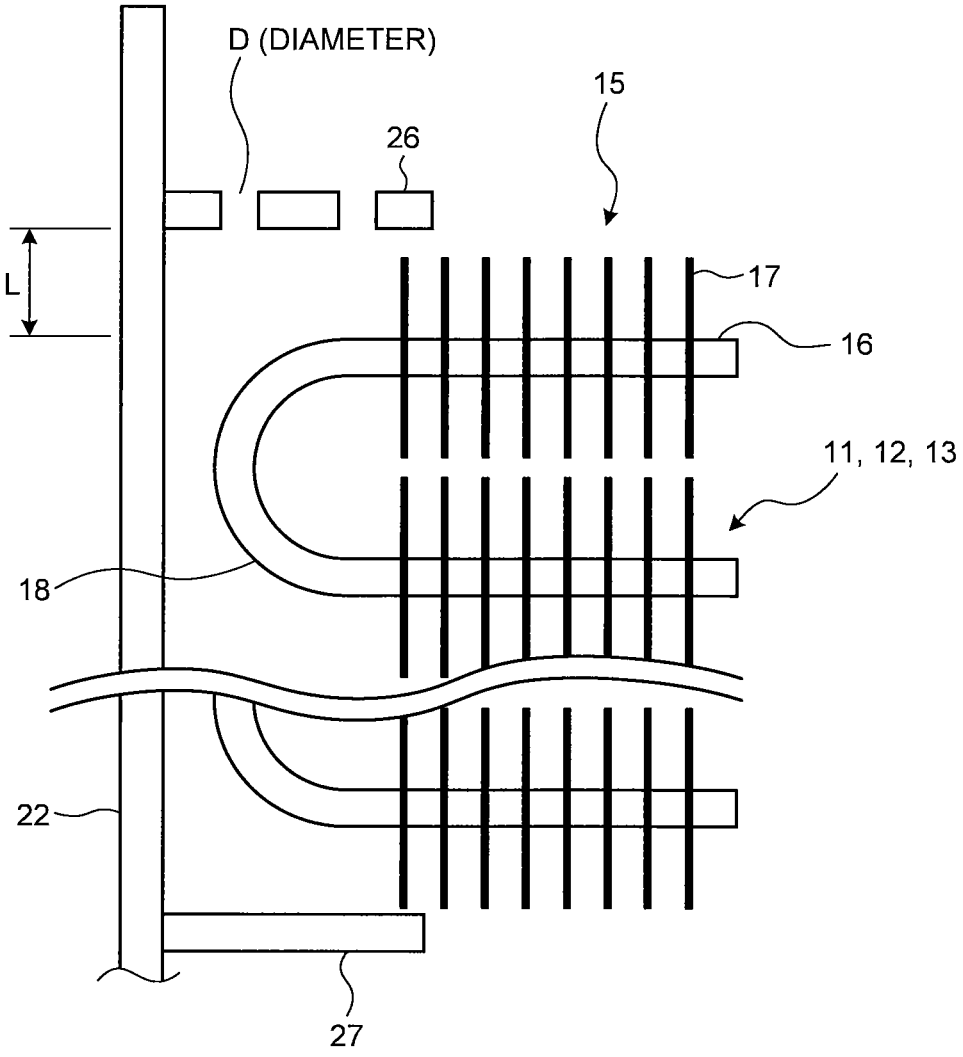
FIG. 4 is an enlarged view around a bare tube part of a fin tube part shown in FIG. 2.

Detailed configurations of the bare-tube-part upstream-side regulating plate 26 and the bare-tube-part downstream-side regulating plate 27 respectively mounted on the ends of the fin tube parts 15 are explained with reference to FIG. 4.

The fin tube part 15 is constituted by a plurality of straight heating medium tubes 16, a spiral heat transfer fin 17 mounted on an outer circumferential surface of each of the heating medium tubes 16, and the bare tube part 18 that connects ends of adjacent heating medium tubes 16.

The heat transfer fin 17 is not mounted on the bare tube part 18 and the bare tube part 18 is accommodated in the heat-transfer tube bundle accommodating duct 22. Accordingly, there is a possibility that gas short-circuit pass occurs in the bare tube part 18.

To prevent gas short-circuit pass, the bare-tube-part upstream-side regulating plate 26 and the bare-tube-part downstream-side regulating plate 27 are mounted on a side-wall of the heat-transfer tube bundle accommodating duct 22 on an upstream side and a downstream side of the bare tube part 18, respectively.

A large number of holes with a diameter D are formed on the bare-tube-part upstream-side regulating plate 26.

An aperture ratio due to the large number of holes is set to be 20 to 50%.

The heating medium tube 16 is placed at a position where a length L between the heating medium tube 16 (an upstream end of the bare tube part 18) and the bare-tube-part upstream-side regulating plate 26 is ten or more times of the diameter D of a hole.

An upper limit of the ratio of the length L to the diameter D of a hole is inevitably determined by a length between adjacent fin tube parts 15 and a size of the heat-transfer tube bundle accommodating duct 22.

Meanwhile, a solid plate is placed as the bare-tube-part downstream-side regulating plate 27.

With this configuration, a pressure loss of a flue gas flow the heating medium tube 16 can be made substantially equal to that at the part of the bare tube part 18. As a result, the flue gas can be regulated (drift can be reduced).

Both of the bare-tube-part upstream-side regulating plate 26 and the bare-tube-part downstream-side regulating plate 27 can be solid. Alternatively, a large number of holes can be formed on the both plates.

Further, the bare-tube-part upstream-side regulating plate 26 and the bare-tube-part downstream-side regulating plate 27 can be made detachable in view of maintenance.

OTHER EMBODIMENTS

While respective embodiments of the present invention have been explained above, it is needless to mention that the present invention is not limited to the embodiments and various modifications can be made within the scope of the invention.

REFERENCE SIGNS LIST

1 boiler
2 denitrification system
3 heat recovery unit (heat exchanger)
4 electronic precipitator
5 desulfurization system
6 repeater
7 stack
8 heating-medium circulating pipe
9 soot blower
10 air blower
11 high-temperature heat-transfer tube bundle
12 medium-temperature heat-transfer tube bundle
13 low-temperature heat-transfer tube bundle
14 header
15 fin tube part (heat transfer unit)
16 heating medium tube
17 heat transfer fin
18 bare tube part (U-shaped tube part)
20 flue gas duct
21 expanded part of duct
22 heat-transfer tube bundle accommodating duct
23 first regulating plate in introducing unit
24 second regulating plate in introducing unit
25 third regulating plate in introducing unit
26 bare-tube-part upstream-side regulating plate
27 bare-tube-part downstream-side regulating plate
So cross-sectional area of flue gas duct
S1 total cross-sectional area of opening of first regulating plate in introducing unit
S2 total cross-sectional area of opening of second regulating plate in introducing unit
S3 total cross-sectional area of opening of third regulating plate in introducing unit
Sd cross-sectional area of heat-transfer tube bundle accommodating duct
Si respective openings of regulating plate in introducing unit
D diameter of hole
L length
Px horizontal flat plate
Py vertical flat plate

The invention claimed is:

1. A heat exchanger including a flue gas duct, an expanded part of a duct, a heat-transfer tube bundle accommodating duct, and a plurality of heat-transfer tube bundles provided in the heat-transfer tube bundle accommodating duct in a flow direction of flue gas with a distance therebetween, the heat exchanger comprising:

a bare-tube-part upstream-side regulating plate and a bare-tube-part downstream-side regulating plate respectively arranged on an upstream side and a downstream side of a bare tube part of each of the heat-transfer tube bundles; and a plurality of regulating plates in an introducing unit arranged either in the expanded part of a duct or in the heat-transfer tube bundle accommodating duct on an upstream side to the heat-transfer tube bundles, wherein the plurality of regulating plates includes a plurality of openings, and is constituted such that positions of the openings of the regulating plate on upstream side in vertical and horizontal directions, as seen from the flow direction, do not coincide with those of the regulating plate on downstream side in the vertical and horizontal directions, the regulating plates include horizontal flat plates and vertical flat plates, and are formed in parallel crosses to form the openings, a flat surface of the horizontal flat plates and the vertical flat plates overlap each other at the crossing such that a thickness of the horizontal flat plates protrude from the flat surface of the vertical flat plates in the direction of a flue duct opening and a thickness of the vertical flat plates protrude from the flat surface of the horizontal flat plates in the direction of the heat-transfer tube bundles or vice versa, the horizontal flat plates are arranged such that a width direction thereof corresponds to the vertical direction with respect to the flow direction, and the vertical flat plates are arranged such that a width direction thereof corresponds to the horizontal direction with respect to the flow direction of the expanded part, and such that flat surfaces of the horizontal flat plates are disposed on a vertical plane to the flow direction, the regulating plates are disposed such that a crossing section of the horizontal flat plate and the vertical flat plate of the regulating plate on the downstream side overlaps with the opening of the regulating plate on the upstream side in the flow directions, a total area of the plurality of openings formed on the regulating plate in the introducing unit on the downstream side is equal to or greater than a total area of the plurality of openings formed on the regulating plate in the introducing unit on the upstream side, the bare-tube-part upstream-side regulating plate being a perforated plate and the bare-tube-part downstream-side regulating plate being a solid plate.

2. The heat exchanger according to claim 1, wherein the bare-tube-part upstream-side regulating plate or the bare-tube-part downstream-side regulating plate is a flat plate.

3. The heat exchanger according to claim 1, wherein an aperture ratio of the plurality of holes of the bare-tube-part upstream-side regulating plate is 20 to 50%.

4. The heat exchanger according to claim 1, wherein a length between the bare-tube-part upstream-side regulating plate and a heating medium tube on an uppermost stream side of each of the heat-transfer tube bundles is at least ten times of a diameter D of the holes.

5. The heat exchanger according to claim 1, wherein the regulating plates in the introducing unit are formed by arranging band-shaped flat plates in parallel crosses.

6. The heat exchanger according to claim 1, wherein a number of the horizontal flat plates is set to be equal to a number of the vertical flat plates, and a distance between each of the horizontal flat plates and each of the vertical flat plates is set to be equal or larger toward the downstream side.

7. The heat exchanger according to claim 1, wherein a number of the horizontal flat plates and a number of the vertical flat plates of the regulating plates are increased toward the downstream side while a size of the openings is unchanged.

* * * * *